US006394338B1

(12) United States Patent
Sluder

(10) Patent No.: US 6,394,338 B1
(45) Date of Patent: May 28, 2002

(54) CONVERTIBLE CONTAINER FOR FOOD AND CONDIMENT

(76) Inventor: Roy Gene Sluder, Rte. 7, Box 419, Greeneville, TN (US) 37743

( * ) Notice: Subject to any disclaimer, the term of this patent is extended or adjusted under 35 U.S.C. 154(b) by 0 days.

(21) Appl. No.: 09/929,327

(22) Filed: Aug. 13, 2001

(51) Int. Cl.[7] ..... B65D 25/04

(52) U.S. Cl. ..... 229/120.15; 229/120.21; 229/121; 229/400; 229/904

(58) Field of Search ..... 229/120.15, 120.21, 229/121, 400, 902, 904, 906; 426/119, 120

(56) References Cited

U.S. PATENT DOCUMENTS

| | | | | | |
|---|---|---|---|---|---|
| 1,855,555 | A | * | 4/1932 | Miller | 229/121 |
| 2,361,852 | A | * | 10/1944 | Locke, Jr. | 229/121 |
| 3,685,640 | A | * | 8/1972 | Tolaas | 229/120.15 |
| 3,920,120 | A | * | 11/1975 | Shveda | 229/400 |
| 4,489,879 | A | * | 12/1984 | Mode | 229/904 |
| 4,729,477 | A | * | 3/1988 | Growney | 229/120.21 |
| 4,804,133 | A | * | 2/1989 | Klyokane | 229/904 |
| 4,915,235 | A | * | 4/1990 | Roosa | 229/121 |
| 4,955,528 | A | | 9/1990 | Schluckebier | |
| 5,337,948 | A | * | 8/1994 | Newsome et al. | 229/120.15 |
| 5,540,333 | A | | 7/1996 | Gonzalez | |
| 5,626,283 | A | | 5/1997 | Mellon | |
| 5,630,544 | A | | 5/1997 | Shane | |
| 5,720,429 | A | | 2/1998 | Cordle | |
| 6,053,402 | A | * | 4/2000 | Thomas et al. | 229/120.21 |
| 6,062,468 | A | | 5/2000 | Tausanovitch | |
| 6,089,375 | A | | 7/2000 | Johnson | |
| 6,102,208 | A | | 8/2000 | Huang | |
| 6,119,930 | A | | 9/2000 | Lunstra | |
| 6,216,946 | B1 | * | 4/2001 | Cai | 229/904 |

* cited by examiner

*Primary Examiner*—Gary E. Elkins
(74) *Attorney, Agent, or Firm*—Susan F. Johnston

(57) ABSTRACT

Disclosed herein is a construction for a single piece blank and a container formed therefrom. The container is convertible between a single-compartment container and a multiple-compartment container. The container is characterized by having a rear panel defining a lateral slit therein and a front panel perforated and scored to define a converting flap hinged to the front panel along a lateral fold line. The container may be converted to a multiple-compartment container by separating the converting flap from the front panel along the perforation row, folding the converting flap along the lateral fold line, positioning the convertible flap between the front panel and the rear panel to be received through the slit. Thus, an upper compartment and a lower compartment are provided, separated by the converting flap.

19 Claims, 7 Drawing Sheets

CONVERTIBLE CONTAINER FOR FOOD AND CONDIMENT

CROSS REFERENCES TO RELATED APPLICATIONS

This application claims no benefits derived from any earlier filed US or foreign patent applications.

BACKGROUND OF THE INVENTION

In the fast-food restaurant industry, elongated prepared foods, such as french-fries, chicken strips, bread sticks, pastries, and such are often sold to consumers packaged in elongated disposable containers, typically having a wider open upper end and a narrower enclosed lower end. In order to minimize materials cost and assembly costs, and provide an easily collapsible and nestable container, the fast-food restaurant industry has generally standardized the use of pouch-style paperboard containers formed from a single paperboard blank using minimal amounts of assembly labor.

With the upper end typically being wider than the lower end of the paperboard pouch, a filled paperboard pouch is unstable when disposed in an upright position. Accordingly, it is common practice for consumers to use the paperboard pouches by resting the pouch on a tabletop in a more stable, laterally extended position to minimize accidental spillage.

Elongated prepared foods are often served in conjunction with a condiment so that the consumer can dip the food into the condiment while dining. The most popularly used condiments are liquid or semi-liquid condiments such as ketchup, mustard, dressings, honey, syrup, icing, relish, and the like. Thus it is necessary to provide some type of surface or container for accessing the condiment. This oftentimes proves to be a messy dilemma.

In recent attempts to improve the fast-food condiment dilemma, several two-compartment paperboard pouches have been designed especially to accommodate dipping by including a separate compartment suitable for containing a condiment. Examples of such designs are disclosed in U.S. Pat. Nos. 5,720,429; 5,626,283; 4,955,528; 6,119,930; 5,540,333; 5,630,544; and 6,102,208. Unfortunately, the two-compartment pouches disclosed in each of the above listed patents are designed for use in the upright position, the position that is most unstable for a pouch-style paperboard container. If disposed in the popular laterally extended position, the condiment would deleteriously pour out of the condiment compartment.

In light of the above, it would be desirable to provide a paperboard pouch-style container having separate compartments for elongated food and condiment that is particularly suited for use while positioned in a laterally extended position. It would be further desirable if such container were formed by folding and affixing a single die cut and from a pliable material such as paperboard. It would be even further desirable if such container were easily convertible between a single compartment container and a multi-compartment container, depending upon the ultimate use thereof.

BRIEF SUMMARY OF THE INVENTION

The present invention includes a container formed from a single blank. The container comprises an enclosed base end, an open upper end, a front panel, a rear panel, a right side and a left side;

a single plane intersecting each of said front and rear panels between the enclosed lower end and the open upper end;

the rear panel defining a slit therethrough in the plane;

the front panel having a fold line extending between a first point and a second point in said plane; and the front panel including a perforation row extending downwardly from the first point and said second point defining a converting flap therebetween, wherein the converting flap has a shape sufficient so that, when the converting flap is separated from the front panel along the perforation row and folded along the fold line the flap is positionable between the front panel and the rear panel in the plane and is partially receivable through the slit, thus providing an upper compartment and a lower compartment separated by the converting flap.

The present invention further includes the single blank from which the container of the present invention is formed.

DETAILED DESCRIPTION

Figure 1:
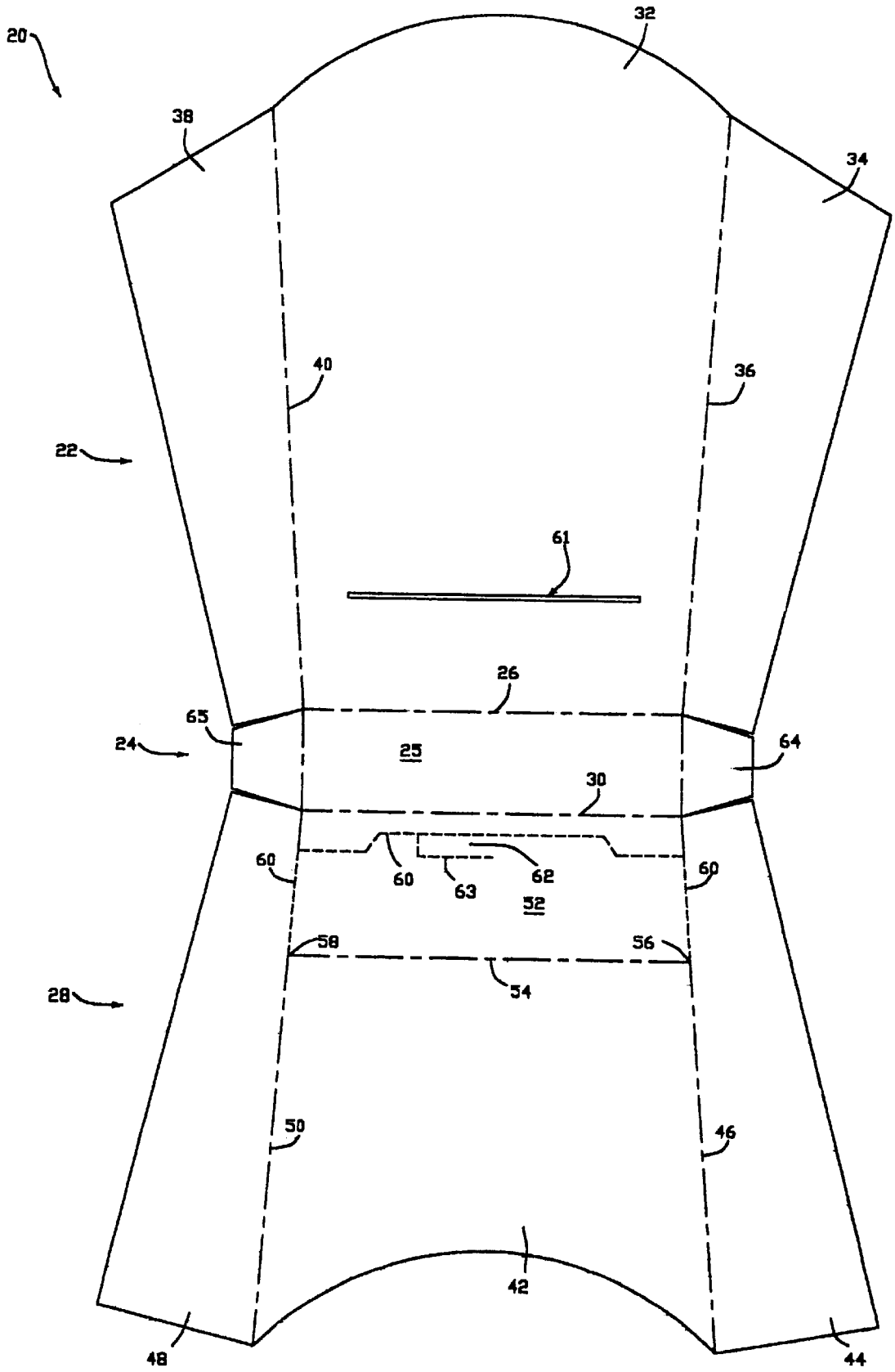
FIG. 1 illustrates a top plan view of an embodiment of the blank of the present invention where the convertible flap has a tapered flap end.

The present invention is a new blank for a container and the container formed therefrom. The container is especially useful in that it is very easily convertible from a single-compartment container to a multicompartment container. The container of the present invention is particularly useful as a multi-compartment container for containing an elongated prepared food and a condiment due to the fact that the container is designed especially for use in the more convenient laterally extended position, instead of in an upright position.

The blank may be cut and scored from any pliable material useful for forming a food product container. Such pliable materials include, for example, flexible plastics, papers, cardboard, paper and plastic blends, with the most preferable material being paperboard. The container of the present invention is formed by folding and intra-connecting the blank of the present invention using folding techniques and gluing, or otherwise affixing, techniques known in the container art.

The blank of the present invention includes at least two, but preferably three, members. The preferred three-member blank of the present invention is described with reference to the alternative embodiments illustrated in FIGS. 1–3. In the three-membered blank, a first member 22 is hinged to a second member 24 along a first fold line 26. A third member 28 is hinged to the second member 24 along a second fold line 30. Fold lines may be straight or curved lines.

The first member 22 has a central portion 32 hinged to an upper right side flap 34 along an upper right fold line 36, with the upper right fold line 36 intersecting the first lateral fold line 26. The central portion 32 of the first member is hinged to an upper left side flap 38 along an upper left fold line 40, with the upper left fold line 40 intersecting the first lateral fold line 26.

The third member 28 has a central portion 42 hinged to a lower right side flap 44 along a lower right fold line 46. The lower right fold line 46 intersects the second fold line 30. The central portion 42 of the third member is also hinged to a lower left flap 48 along a lower left fold line 50. The lower left fold line 50 intersects the second fold line 30.

The side flaps compose the two sides of the container formed from the blank. Therefore, the shape and size of the side flaps should be suitable for overlapping with each other to form the side panels of the container. The blank of the present invention also includes an embodiment having only one right side flap and one left side flap, as part of either the first or third member. If a single side flap is incorporated on each side of the blank, the flap should be large enough to connect the front panel of the. container (formed by central portion 42) with the back panel of the container (formed by central portion 32).

The blank 20 of the present invention is characterized by including perforations that provide a flap particularly designed to enable the container formed from the blank to be converted from a single compartment container to a multiple compartment container. The central portion 42 of the third member is scored with a winding perforation row 60 to define therein a semi-separable flap 52, referred to hereinafter as the "convertible flap". The convertible flap 52 is intricately connected to the third member along a third lateral fold line 54 that is substantially parallel to the second lateral fold line and extends from a first point 56 to a second point 58. The convertible flap 52 is separable from the third member along a winding perforation row 60 beginning at the first point 56 and extending upwardly to a point proximate the second member 24 and then winding downwardly to the second point 58. Thus, the convertible flap 52 has a flap end opposite the third lateral fold line 54. In the present invention, a fully cut line used for defining the convertible flap 54 is considered within the meaning of a "perforation row". However, a winding row of distinct, closely spaced, perforations through the material is preferable since it provides versatility for using the container as a single compartment or multi-compartment container.

Figure 5:
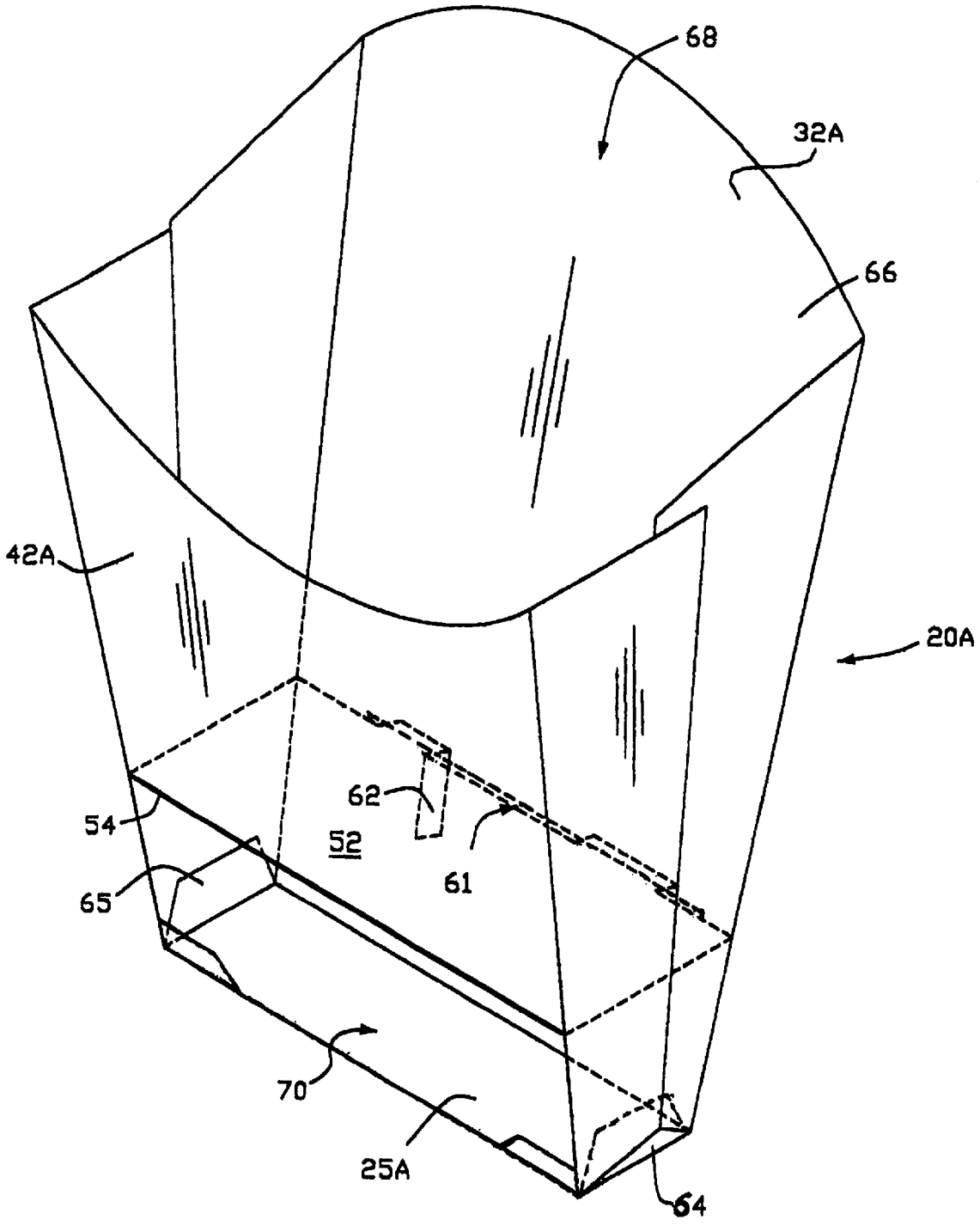
FIG. 5 illustrates a perspective front view of the present convertible container, in phantom, in an upright position in the tab locked, multicompartment mode.

The blank of the present invention is further characterized in that the central portion 32 of the first member 22 includes a slit 61 that is substantially parallel to the second fold line 30 and is adapted to receive at least a portion of the flap end of the convertible flap 52 therethrough. The positionment, size, and shape of the slit 61 and the convertible flap 52 must be sufficient so that the flap end of the convertible flap is received through the slit when the convertible flap is separated from the third member along the perforation row and the blank is folded to form a pouch-style container as shown in FIG. 5.

Figure 2:
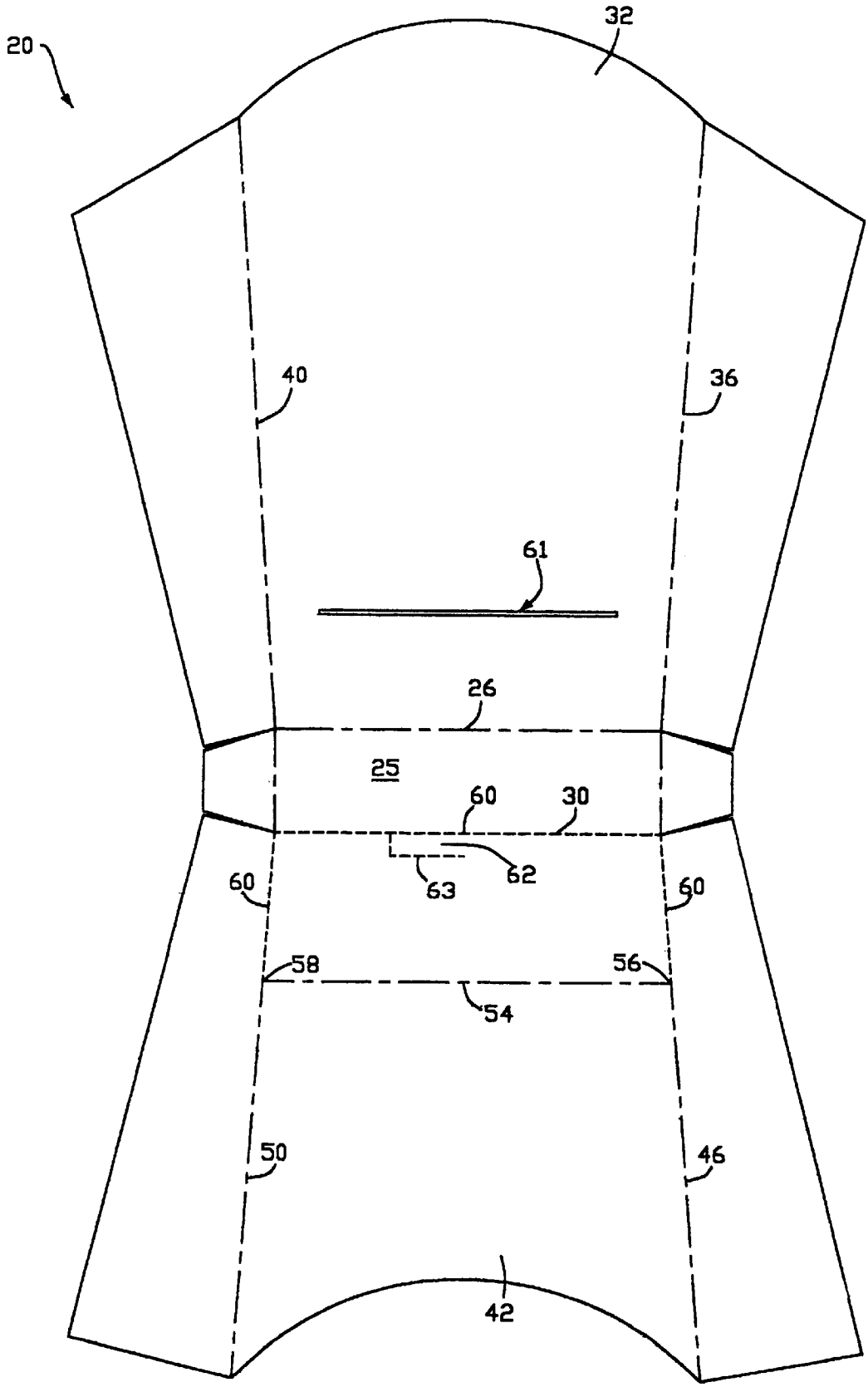
FIG. 2 illustrates a top plan view of an embodiment of the blank of the present invention where the convertible flap has a flap end defined along the left and right fold lines.
Figure 3:
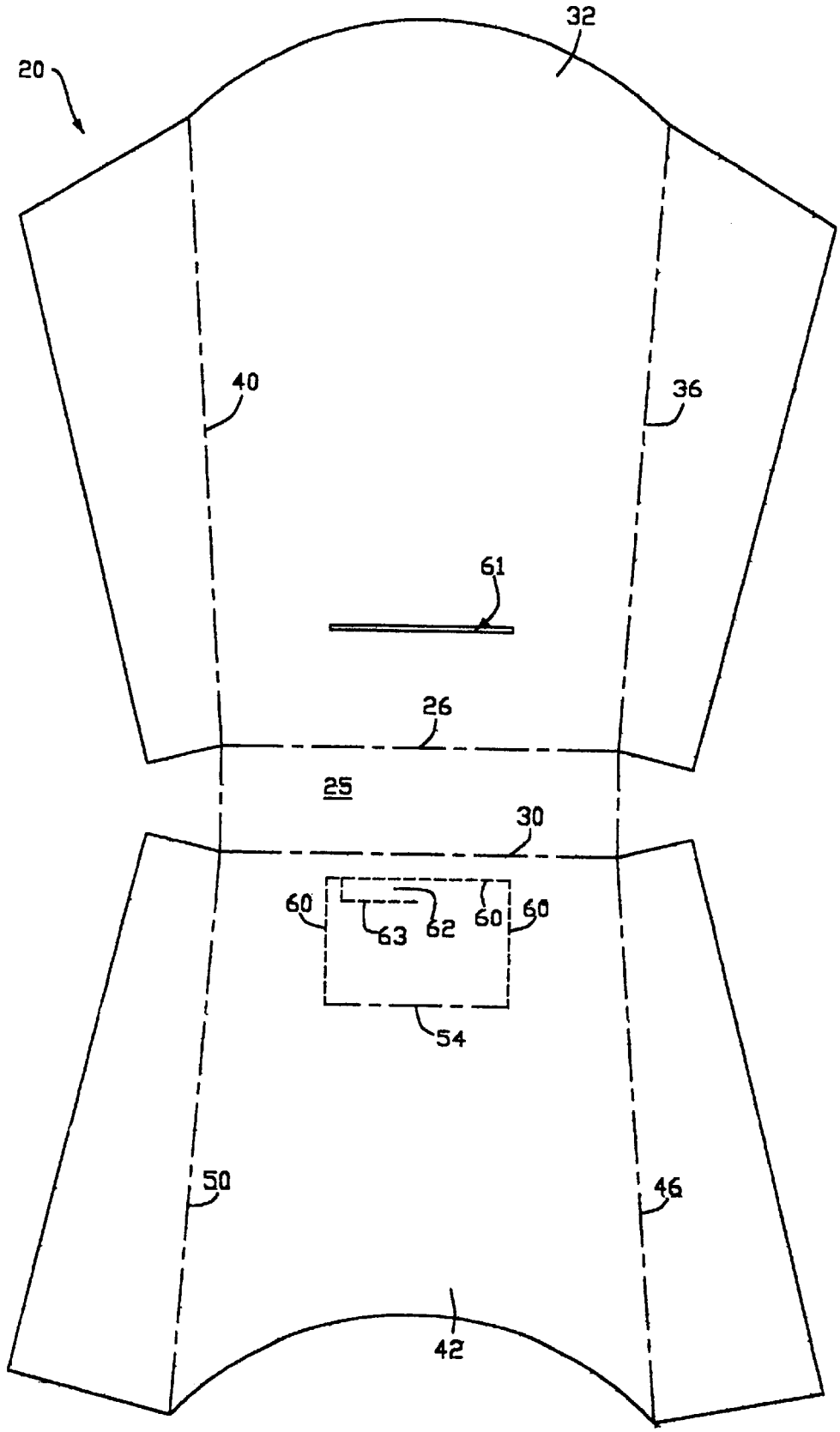
FIG. 3 illustrates a top plan view of an embodiment of the blank of the present invention having a relatively small convertible flap.
Figure 4:
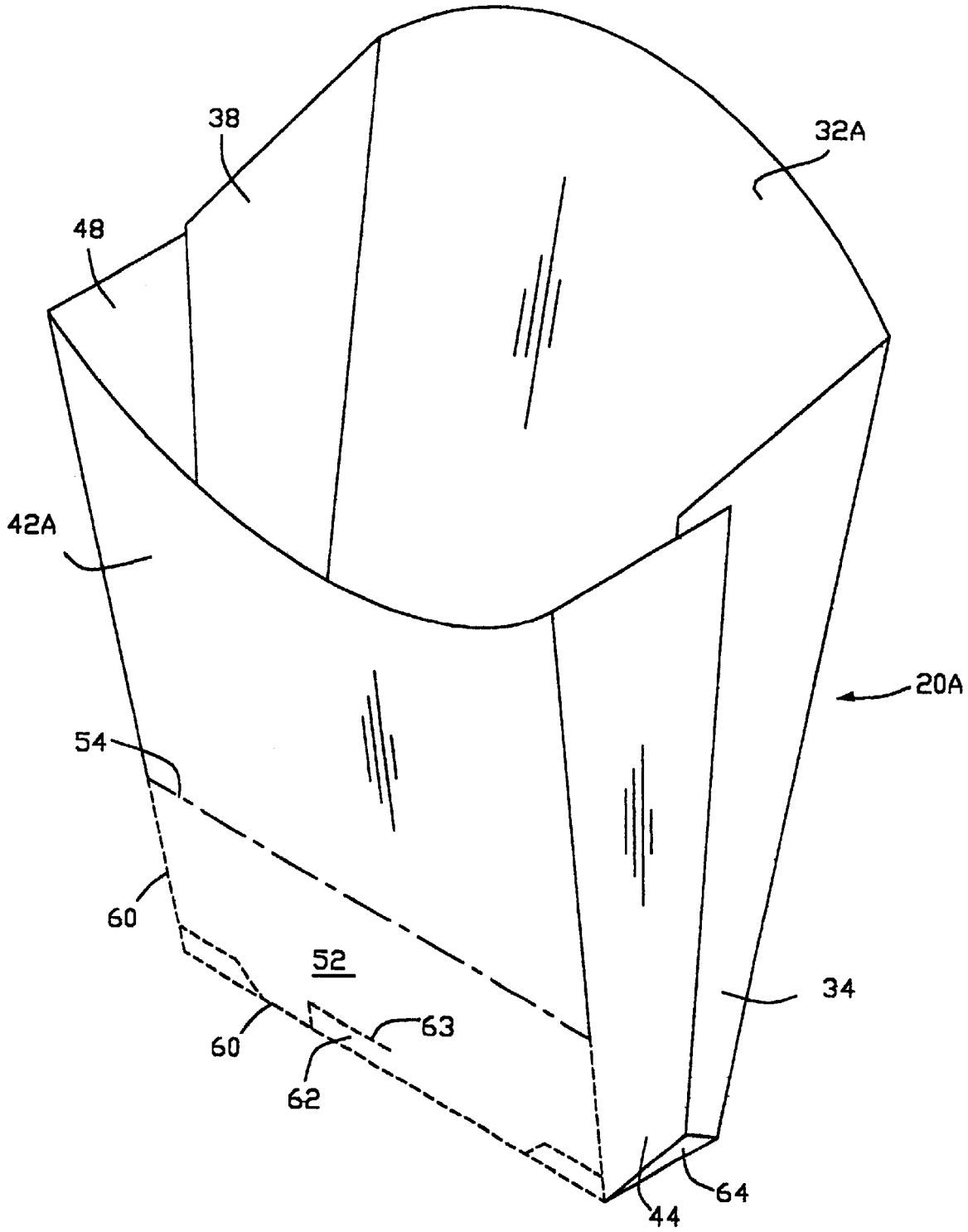
FIG. 4 illustrates a perspective front view of the present convertible container in an upright position in the single-compartment mode.
Figure 6:
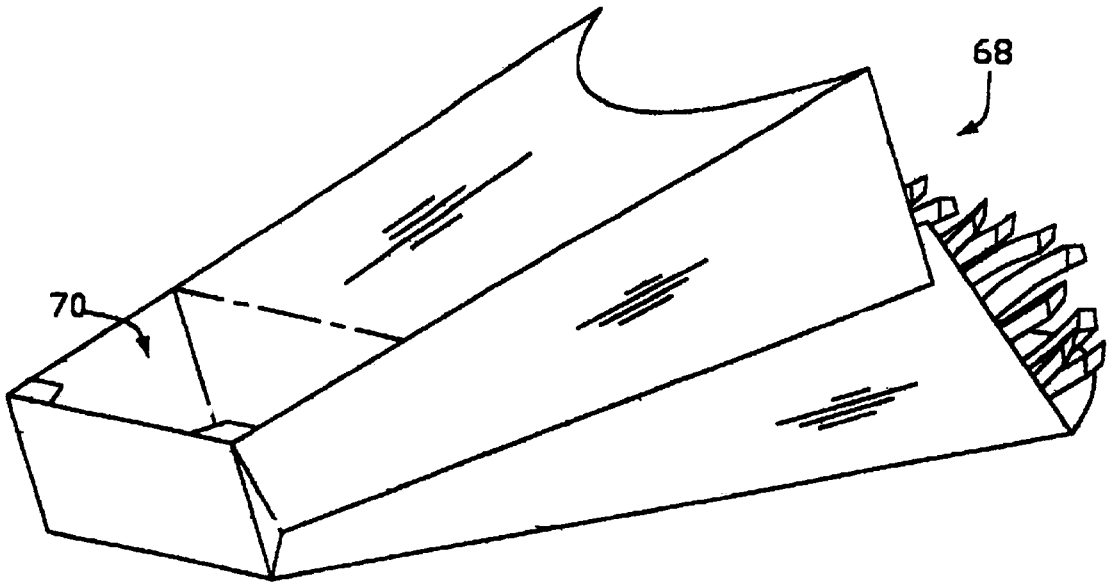
FIG. 6 illustrates a perspective view of the present convertible container as used in a lateral position in the multi-compartment mode filled with french-fries in the upper compartment and having an unfilled lower compartment.
Figure 7:
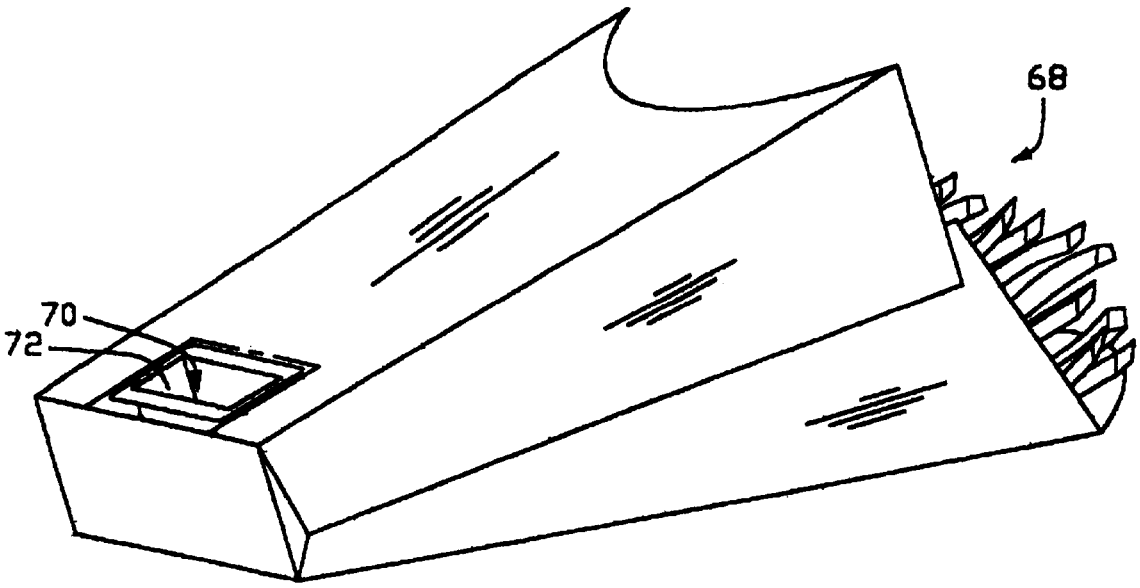
FIG. 7 illustrates a perspective view of the convertible container formed from the blank shown in FIG. 3 as used in a lateral position in the multi-compartment mode filled with french-fries in the upper compartment and containing a small condiment cup in the lower compartment.

The shape of the convertible flap may vary, depending upon the intended ultimate use of the container. For example, FIG. 1 illustrates an embodiment of the blank 20 wherein the convertible flap 52 has a tapered flap end disposed away from the lateral fold line 30. Alternatively, FIG. 2 illustrates a convertible flap defined by a perforation row 60 running along fold lines 30, 46, and 50. The container shown in FIGS. 4, 5, and 6 is formed from a blank that is a hybrid between FIG. 1 and FIG. 2. Another useful embodiment of the present blank is shown in FIG. 3 where the convertible flap is formed by a relatively short third lateral fold line 54 and a perforation row 60 confined below the third lateral fold. The container shown in FIG. 7 is formed from the blank of FIG. 3 and is especially useful for holding a condiment cup.

Figure 8:
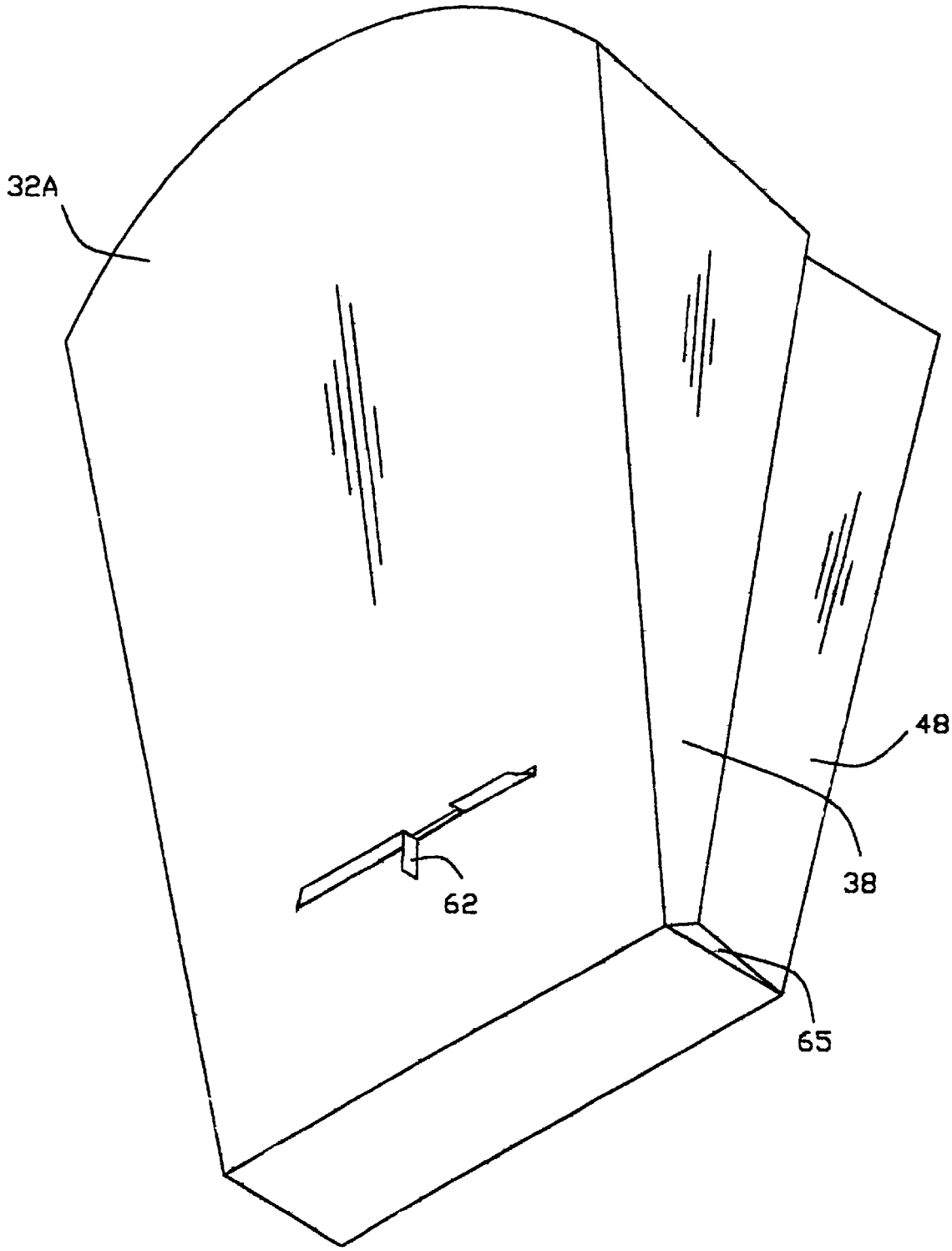
FIG. 8 is a perspective view of the container illustrating the flipdown locking mechanism of the tab.

In the present invention, the flap end of the convertible flap 52 preferably includes a lateral tab 62 defined by another perforation row 63. The tab 62 is useful for easily locking the convertible flap 52 into position through the slit 61. FIG. 8 illustrates the simple, yet effective, flip down locking mechanism of the tab 62.

The central portion 25 of the second member 24 of the three-membered blank is preferably hinged to a right anti-leak flap 64 along a right fold line and a left anti-leak flap 65 along a left fold line. The right and left fold lines of the second member intersect the first and second lateral fold lines. The pair of anti-leak flaps provides protection against a liquid condiment such as ketchup leaking out of the container, as can easily be seen in FIG. 5.

As stated above, the present invention also includes a two-membered blank. The two-membered blank has the same elements as the three-membered blank described above and shown in FIGS. 1–3, except for the omission of the second member 24. The two-membered single piece blank comprises an upper member hinged to a lower member along a center lateral fold line, with the upper member having the attributes of the first member of the three-membered blank and the lower member having the attributes of the third member of the three-membered blank. It can be easily seen that the left and right side flaps of a two-membered single blank would necessitate a slightly different shape than needed for a three-member blank. The container formed by a two-member blank would have a V-shaped base end, and would be unsuitable for use in an upright position. However, since one of the objects of the present invention is to provide a multi-compartment container that is useful in the laterally extended position, such a container would be suitable.

The blank of the present invention may be folded and glued, or otherwise affixed, to provide the container of the present invention, as shown in FIGS. 4–8. The convertible container of the present invention has a base end, an upper filling end 66, a front panel 42A, and a rear panel 32A. In the container shown in the Figures, the base end is formed by a base panel 25A. However, a container formed from a two-membered blank will have a V-shaped base end formed by the juncture of the front panel 42A and the rear panel 32A. The convertible container is characterized by a front panel 42A including the above described convertible flap 52 and a rear panel 32A including the above described slit 61.

The preferred embodiment of the convertible container of the present invention comprises four adjacent elongated panels including a pair of side panels, a front panel 42A, and a rear panel 32A. Each of the panels extends upwardly from an enclosed lower end 25A to define an open upper end 66. The slit 61 is disposed on the rear panel 32A in a plane that also intersects the front panel 42A. The third lateral fold line 54 is disposed on the front panel 42A substantially in the same plane. The convertible flap 52 has a shape and size sufficient so that, when the convertible flap is separated from the front panel 42A along the perforation row 60, the flap may be positioned between the front and rear panels and received through the slit 61. Thus, the convertible flap 52 becomes a divider between an upper compartment 68 and a lower compartment 70 in the multicompartment container mode.

In the container, the plane containing the slit and the third lateral fold line 54 is preferably substantially perpendicular to the container side panels so that the convertible flap 52 may lie substantially parallel to the enclosed lower end 25A while in the multi-compartment mode. "Substantially parallel" and "substantially perpendicular" are defined herein as being no further than about 35 degrees from an actual parallel or perpendicular line.

The present invention further includes the multi-compartment container having the upper compartment 68 and the lower compartment 70 separated by the convertible flap 52. As shown in FIG. 5, in the multicompartment container, the rear panel 32A and pair of side panels extend from the open upper end 66 to the enclosed lower end. The front panel 42A extends from the open upper end 66 to the converting flap 52 at a position above the enclosed lower end. The converting flap 52 extends rearwardly from the front panel 42A and through the slit 61 in the rear panel 32A.

It should be appreciated that the optimum design of the convertible flap and slit will depend upon whether the lower compartment 70 is intended to be used to directly contain a condiment or else to stabilize a small cup 72 filled with condiment. In order to be suitable for direct containment of a liquid condiment, it is preferred that the slit 61 be sized small enough to be essentially filled by the portion of the convertible flap 52 occupying the slit so that a liquid condiment is not apt to seep out of the container through the slit 61. The anti-leak flaps 64 and 65 are also quite helpful in avoiding leaks.

It should be further appreciated that a container formed from the blank shown in FIG. 1 and FIG. 2 would be more preferable when condiment is directly contained in the lower compartment 70 since the food in the upper compartment 68 would be better separated from condiment in the lower compartment 70.

The present invention further includes a blank and resulting container having three or more compartments to accommodate multiple food and condiment requirements.

In the drawings and specification, there have been disclosed typical preferred embodiments of the invention and, although specific terms are employed, they are used in a generic and descriptive sense only and not for purposes of limitation. It will be understood that variations and modifications can be effected within the spirit and scope of the invention, the scope of the invention being set forth in the following claims.

What is claimed is:

1. A single piece blank cut and scored from a pliable material for use as a container comprising:

a first member, a second member, and a third member, each of said members including a central portion having a right side, a left side, an upper side, and a lower side;

the lower side of said central portion of said first member hinged to the upper side of said central portion of said second member along a first lateral fold line;

the lower side of said central portion of said second member hinged to the upper side of said central portion of said third member along a second lateral fold line;

the right side of at least one of said central portion of said first member and said central portion of said third member being hinged to a right side flap along a right fold line, said right fold line intersecting the nearest of said first and second lateral fold lines;

the left side of at least one of said central portion of said first member and said central portion of said third member being hinged to a left side flap along a left fold line, said left fold line intersecting the nearest of said first and second lateral fold lines;

said central portion of said third member including a third lateral fold line substantially parallel to said second lateral fold line and extending between a first point and a second point, and a perforation row extending upwardly from said first point to a point proximate said second member and then winding downwardly to said second point to define a convertible flap therein having a flap end opposite said third lateral fold line; and said central portion of said first member defining a slit substantially parallel to said second fold line, said slit being adapted to receive said flap end when said convertible flap is separated from said third member along said perforation row and the blank is folded to form a container.

2. The blank according to claim 1 wherein at least one of said first member and said third member includes both a right side flap and a left side flap.

3. The blank according to claim 2 wherein each of said first member and said third member includes both a right side flap and a left side flap.

4. The blank according to claim 1 further wherein said central portion of said second member is hinged to a right anti-leak flap along a right fold line intersecting said first and second lateral fold lines and hinged to a left anti-leak flap along a left fold line intersecting said first and second lateral fold lines.

5. The blank according to claim 1 wherein said converting flap includes, at said flap end, a lateral tab partially separable from said converting flap along another perforation row defining said tab.

6. The blank according to claim 1 formed from a piece of paperboard.

7. The blank according to claim 1, wherein said blank is folded and intra-connected to form a container.

8. A single piece blank cut and scored from a pliable material for use as a container comprising:

an upper member hinged to a lower member along a lateral center fold line; said upper member and said lower member each having a central portion having a right side and a left side;

the right side of said central portion of at least one of said upper and lower members having a right flap hinged thereto along a right fold line, said right fold line intersecting said center fold line;

the left side of said central portion of at least one of said upper and lower members having a left flap hinged thereto along a left fold line, said left fold line intersecting said lateral center fold line;

said central portion of said upper member defining a slit therein substantially parallel to said lateral center fold line; and said central portion of said lower member including a lower fold line substantially parallel to said lateral center fold line and extending between a first point and a second point, a perforation row extending upwardly from said first point toward said lateral center fold line then extending downwardly to said second point to define a convertible flap therein having a flap end opposite said lower fold line, wherein said slit is adapted to receive the flap end of said convertible flap when said convertible flap is separated from said lower member along said perforation row and said blank is folded along said lateral center fold line and along said right and left side fold lines to form a container.

9. The blank according to claim 8 wherein said converting flap includes, at said flap end, a lateral tab partially separable from said converting flap along another perforation row defining said tab.

10. The blank according to claim 8 formed from a piece of paperboard.

11. The blank according to claim 8, wherein said blank is folded and intra-connected to form a container.

12. A container formed from a single blank comprising:

an enclosed base end, an open upper end, a front panel, a rear panel, a right side and a left side;

a single plane intersecting each of said front and rear panels between said enclosed lower end and said open upper end;

said rear panel defining a slit therethrough in said plane;

said front panel having a fold line extending between a first point and a second point in said plane; and said front panel including a perforation row extending downwardly from said first point and said second point defining a converting flap therebetween, wherein said converting flap has a shape sufficient so that, when said converting flap is separated from said front panel along said perforation row and folded along said fold line said flap is positionable between said front panel and said rear panel in said plane and is partially receivable through said slit, thus providing an upper compartment and a lower compartment separated by said converting flap.

13. The container according to claim 12, said container comprising four adjacent elongated panels including a pair of side panels, said front panel, and said rear panel, each of said panels extending upwardly from a enclosed lower end to define said open upper end.

14. The container according to claim 12 wherein said plane is substantially perpendicular to said front panel and said rear panel.

15. The container according to claim 12 wherein said converting flap includes a flap end opposite said fold line and said slit is adapted to receive said flap end.

16. The container according to claim 15 wherein said converting flap includes, at said flap end, a lateral tab partially separable from said converting flap along another perforation row defining said tab.

17. A multi-compartment container formed from a single blank, comprising:

an enclosed lower end;

an open upper end defined by a plurality of adjacent elongated panels, said panels including a rear panel and a front panel;

said rear panel extending from said enclosed lower end to said open upper end;

said rear panel defining a lateral slit therethrough;

said front panel extending from a truncated position above said enclosed lower end to said open upper end; and a flap extending rearwardly from said front panel at said truncated position to said rear panel and through said slit.

18. The container according to claim 17 wherein said container is formed from paperboard.

19. The container according to claim 17 comprising a base panel at said enclosed lower end, a pair of side panels between said front panel and said rear panel, each of said pair of side panels having an anti-leak flap layered adjacently against said panel inside said container, said anti-leak flaps being connected to said base panel.

* * * * *